US012252827B2

(12) United States Patent
Magnusson

(10) Patent No.: US 12,252,827 B2
(45) Date of Patent: Mar. 18, 2025

(54) LAUNDRY WASHING MACHINE

(71) Applicant: Roderinno AB, Nacka Strand (SE)

(72) Inventor: Fredrik Magnusson, Saltsjö-boo (SE)

(73) Assignee: Roderinno AB, Nacka Strand (SE)

( * ) Notice: Subject to any disclaimer, the term of this patent is extended or adjusted under 35 U.S.C. 154(b) by 164 days.

(21) Appl. No.: 17/795,404

(22) PCT Filed: Jan. 30, 2021

(86) PCT No.: PCT/EP2021/052222
§ 371 (c)(1),
(2) Date: Jul. 26, 2022

(87) PCT Pub. No.: WO2021/152158
PCT Pub. Date: Aug. 5, 2021

(65) Prior Publication Data

US 2023/0054491 A1 Feb. 23, 2023

(30) Foreign Application Priority Data

Jan. 31, 2020 (SE) ..... 2050104-5

(51) Int. Cl.
*D06F 21/04* (2006.01)
*D06F 21/00* (2006.01)
(Continued)

(52) U.S. Cl.
CPC ..... *D06F 21/04* (2013.01); *D06F 21/00* (2013.01); *D06F 39/08* (2013.01); *D06F 47/06* (2013.01); *D06F 15/02* (2013.01)

(58) Field of Classification Search
CPC ..... D06F 15/02; D06F 21/00; D06F 21/04; D06F 39/08; D06F 47/06
See application file for complete search history.

(56) References Cited

U.S. PATENT DOCUMENTS 1,949,278 A 2/1934 Johnson
2,692,494 A * 10/1954 Candor ..... D06F 13/00 68/21
(Continued)

FOREIGN PATENT DOCUMENTS

CH 226437 A 4/1943
CN 204530216 U 8/2015
(Continued)

OTHER PUBLICATIONS

Written Opinion and International Search Report corresponding to Application No. PCT/EP2021/052222 mailed Apr. 1, 2021.
(Continued)

*Primary Examiner* — Joseph L. Perrin
(74) *Attorney, Agent, or Firm* — Renner, Otto, Boisselle & Sklar, LLP

(57) ABSTRACT

A laundry washing machine contains a rotatable drum (210) configured to hold laundry (240) during washing thereof. The rotatable drum (210), in turn, contains at least one flexible body (215) configured to alter its volume in response to a fluid medium (F) being fed into or extracted out from an interior of the at least one flexible body (215). As a result, the at least one flexible body (215) varies a volume available for washing fluids (W) and the laundry (240) in the rotatable drum (210), so that for example gentle and yet highly efficient kneading washing actions can be performed.

12 Claims, 7 Drawing Sheets

(51) Int. Cl.

| | |
|---|---|
| ***D06F 39/08*** | (2006.01) |
| ***D06F 47/06*** | (2006.01) |
| *D06F 15/02* | (2006.01) |

(56) References Cited

U.S. PATENT DOCUMENTS

| | | | | | |
|---|---|---|---|---|---|
| 2,712,229 | A * | 7/1955 | Jones | D06F 47/06 | 68/21 |
| 2,737,039 | A * | 3/1956 | Wales | B30B 9/22 | 68/21 |
| 2,743,599 | A * | 5/1956 | Bilde | D06F 47/06 | 68/12.14 |
| 2,749,735 | A | 6/1956 | Candor | | |
| 2,759,348 | A * | 8/1956 | Gibson | D06F 29/02 | 68/21 |
| 2,817,228 | A * | 12/1957 | Koplin | D06F 47/06 | 68/242 |
| 2,824,438 | A * | 2/1958 | Candor | D06F 47/06 | 100/211 |
| 4,763,495 | A * | 8/1988 | Hayashi | B30B 9/22 | 100/211 |
| 2016/0258097 | A1 | 9/2016 | Hake et al. | | |

FOREIGN PATENT DOCUMENTS

| | | | |
|---|---|---|---|
| CN | 206279353 | U | 6/2017 |
| CN | 107217441 | A | 9/2017 |
| CN | 110409103 | A | 11/2019 |
| DE | 1485006 | A1 | 5/1969 |
| WO | 2018222125 | A1 | 12/2018 |
| WO | 2019004896 | A1 | 1/2019 |

OTHER PUBLICATIONS

Swedish Search Report corresponding to Swedish Application No. 2050104-5 mailed on Sep. 7, 2020.

Communication pursuant to Article 94(3) EPC for corresponding European Application No. 21 702 968.5 dated Sep. 9, 2024.

* cited by examiner

LAUNDRY WASHING MACHINE

This application is a national phase of International Application No. PCT/EP2021/052222 filed Jan. 30, 2021, which claims priority to Swedish Application No. 2050104-5 filed Jan. 31, 2020, each of which is hereby incorporated herein by reference in its entirety.

TECHNICAL FIELD

The invention relates generally to automatic washing of laundry. In particular, the present invention concerns a laundry washing machine for washing clothes and other textile items, the dirtiness of which may vary over a very broad range.

BACKGROUND

Today, numerous types of laundry washing machines are known that are highly efficient in terms of mechanically removing dirt particles and similar undesired fragments from clothes. Virtually every one of these machines operate according to a principle where a cylindrical drum rotates and thus causes pieces of laundry to tumble and be tossed around together with detergents. The cylindrical drum may either be arranged with its rotation axis oriented horizontally or vertically. This, of course, affects how gravity interacts with the movements of the pieces of laundry inside the drum. In general, however, the washing functionality is the same in both cases, namely mechanical action in the form of turning, shaking and rubbing fabric surfaces against one other and against the walls of the drum until the dirt particles have been removed, and can subsequently be conveyed out from the drum via openings in the drum wall.

Such mechanical treatment typically accomplishes good washing results, especially if the laundry is relatively dirty. However, these results come at a price, for example in terms of high water consumption, severe wear on the clothing and water pollution due to microfibers being torn away in the washing process. The drum-based laundry washing machines are also fairly noisy and cause vibrations.

Therefore, in recent years, alternative types of washing machines have been presented. For instance, WO 2018/222125 describes a washing machine that has a main part and a flexible washing compartment in which the washing of the laundry takes place. The flexible washing compartment has a sealable opening for receiving the laundry to be washed. The washing machine further has an inlet for supplying washing water into the flexible washing compartment and an outlet for disposal of washing water from the flexible washing compartment. A mechanical pressure device is arranged at the flexible washing compartment to provide mechanical lifting pressure on the outside of a part of the flexible washing compartment, such that the laundry is subjected to mechanical action to assist washing.

WO 2019/004896 shows a washing machine that includes one or more flexible washing compartments that each contains a particular washing zone, in which a flow of washing water typically containing detergents and/or stain removers, is arranged to oscillate through a stacked layer of laundry. Consequently, progressive washing is obtained essentially of the whole content of the stacked laundry.

The latter two solutions above tackle the problems of high water consumption, severe wear on the clothing and microfiber related water pollution. However, at least in some cases when the laundry is very dirty, these solutions may be inferior to the drum-based mechanical laundry washing machines with respect to cleaning efficiency.

SUMMARY

It is therefore an object of the present invention to offer an automatic laundry washing solution that attains a good cleaning result regardless of how dirty the laundry is, and at the same time, avoids unnecessary use of water, minimizes the amount of microfibers being emitted into the sewage as well as prevents excessive wear on the clothes.

According to the invention, this object is achieved by a laundry washing machine containing a rotatable drum configured to hold laundry during washing thereof. The rotatable drum includes at least one flexible body configured to alter its volume in response to a fluid medium being fed into or extracted out from an interior of the at least one flexible body. As a result, a volume available for washing fluids and the laundry in the rotatable drum varies.

This laundry washing machine is advantageous because it can operate according to a very broad range of washing programs including everything from extremely mild programs, where cleaning fluids are gently driven through stationary pieces of laundry to intense programs involving highly agitating washing actions, where for example the laundry is subjected to quick movements and high temperatures. Thus, a tailored washing program can be employed for each degree of laundry dirtiness.

Furthermore, the proposed combination of the rotatable drum and the at least one flexible body enables entirely new washing actions, such as wherein pieces of laundry are turned and kneaded repeatedly in an alternating process. Thereby, washing liquids can be systematically passed through different combinations of layers of fabric, which accomplishes a very efficient cleaning. Since such a process means that the laundry is pressed in more angles than in conventional laundry machines, this also leads to less wrinkles and creases in the cleaned laundry.

According to one embodiment of the invention, the laundry washing machine contains a rotating shaft that drives the rotatable drum. The rotating shaft has a passage configured to feed the fluid medium into and extract the fluid medium out from the at least one flexible body. Thus, the at least one flexible body can be controlled to alter its shape and volume in an efficient and convenient manner via pump mechanisms outside the rotatable drum also during rotation thereof.

According to another embodiment of the invention, at least one of the at least one flexible body is non-axially arranged relative to the rotating shaft in the rotatable drum. This design is advantageous inter alia because it enables agitators of different shapes and sizes to be formed in the rotatable drum. Depending on the size and shape of the agitators, the agitators can assist in causing the laundry to be tossed and tumbled in various ways in the rotatable drum.

According to one embodiment of the invention, the at least one flexible body is configured to receive the fluid medium so as to expand its/their volume to create at least one delimited space for washing fluids and the laundry inside the rotatable drum. This is suitable for washing of few or smaller pieces of laundry since it requires less water.

According to yet another embodiment of the invention, the at least one flexible body is configured to receive the fluid medium so as to expand its/their volume until the laundry is at least temporarily fixated against an inside surface of the rotatable drum. Consequently, pieces of laundry can be held stationary during an entire washing program. As an alternative, or in addition thereto, according to one embodiment of the invention, the rotatable drum is configured to execute washing actions involving rotation of the rotatable drum while the at least one flexible body causes the laundry to be kneaded against an inside surface of the rotatable drum by pulsating the fluid medium to be fed into and out from the interior of the at least one flexible body. This results in repeated expansion and contraction of the at least one flexible body. Thereby, the laundry can be kneaded and rubbed while washing liquids are passed there though, thus providing efficient washing of delicate clothing that is severely soiled.

According to still another embodiment of the invention, the at least one flexible body contains one central flexible body that is arranged symmetrically around the rotating shaft in the rotatable drum. The central flexible body is configured to expand in an expansion direction away from the fluid-medium passage. The expansion direction is here parallel, or at least essentially parallel, to a symmetry axis of the rotatable drum. This accomplishes a reduced drum volume between the central flexible body and the drum door, which is suitable for washing small amounts of laundry with efficient use of water. Alternatively, or additionally, the laundry may be kneaded/rubbed against a rigid surface, e.g. the drum door, as described above by repeated expansion and contraction of the central flexible body.

Preferably, the rotatable drum contains a set of openings configured to allow the washing fluids to be discharged into a receiving chamber surrounding the rotatable drum. According to one embodiment of the invention, the set of openings include first and second zones; where, in the first zone, a ratio between a total opening area and a total non-opening area is higher than the ratio between the total opening area and the total non-opening area in the second zone. The first zone is located closer to the fluid-medium passage than the second zone. Hence, also if the at least one flexible body has been expanded so that the washing volume is reduced, the washing liquids can exit efficiently from the rotatable drum.

When the central flexible body has been expanded to less than a maximal volume, an exterior side surface of the central flexible body is exposed to the washing fluids. According to one embodiment of the invention, the exterior side surface contains at least one fluid conveying pattern, which is configured to transport the washing fluids from the exterior side surface towards the set of openings the rotatable drum. This further improves the emission of washing liquids from the rotatable drum in emptying phases of a washing program.

According to yet another embodiment of the invention, the rotatable drum is configured to execute washing actions involving rotation of the rotatable drum intended to cause the laundry therein to tumble. As a result, conventional drum-based laundry washing can be effected.

Further, according to one embodiment of the invention, the laundry washing machine contains at least one pressure generator configured to force the washing liquids to pass through the laundry while the at least one flexible body causes the laundry to be fixated, at least temporarily, against an inside surface of the rotatable drum. Here, the fluid medium is pulsated to be fed into and out from the interior of the at least one flexible body while the rotatable drum is stationary, at least temporarily. This typically accomplishes good a washing result if the laundry is mildly dirty. In other situations, it may be more efficient to control the at least one pressure generator to force the washing liquids to pass through the laundry while the at least one flexible body causes the laundry to be kneaded against an inside surface of the rotatable drum while the rotatable drum either rotates or is held stationary.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DETAILED DESCRIPTION

Figure 1:
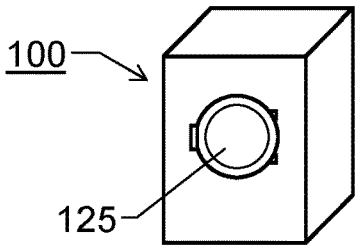
FIG. 1 shows a highly schematic perspective view of a laundry washing machine according to one embodiment of the invention.

FIG. 1 shows a highly schematic perspective view of a laundry washing machine 100 according to one embodiment of the invention. The laundry washing machine 100 has a drum door 125 that provides access to a rotatable drum 210 for holding laundry to be washed.

Figure 2A:
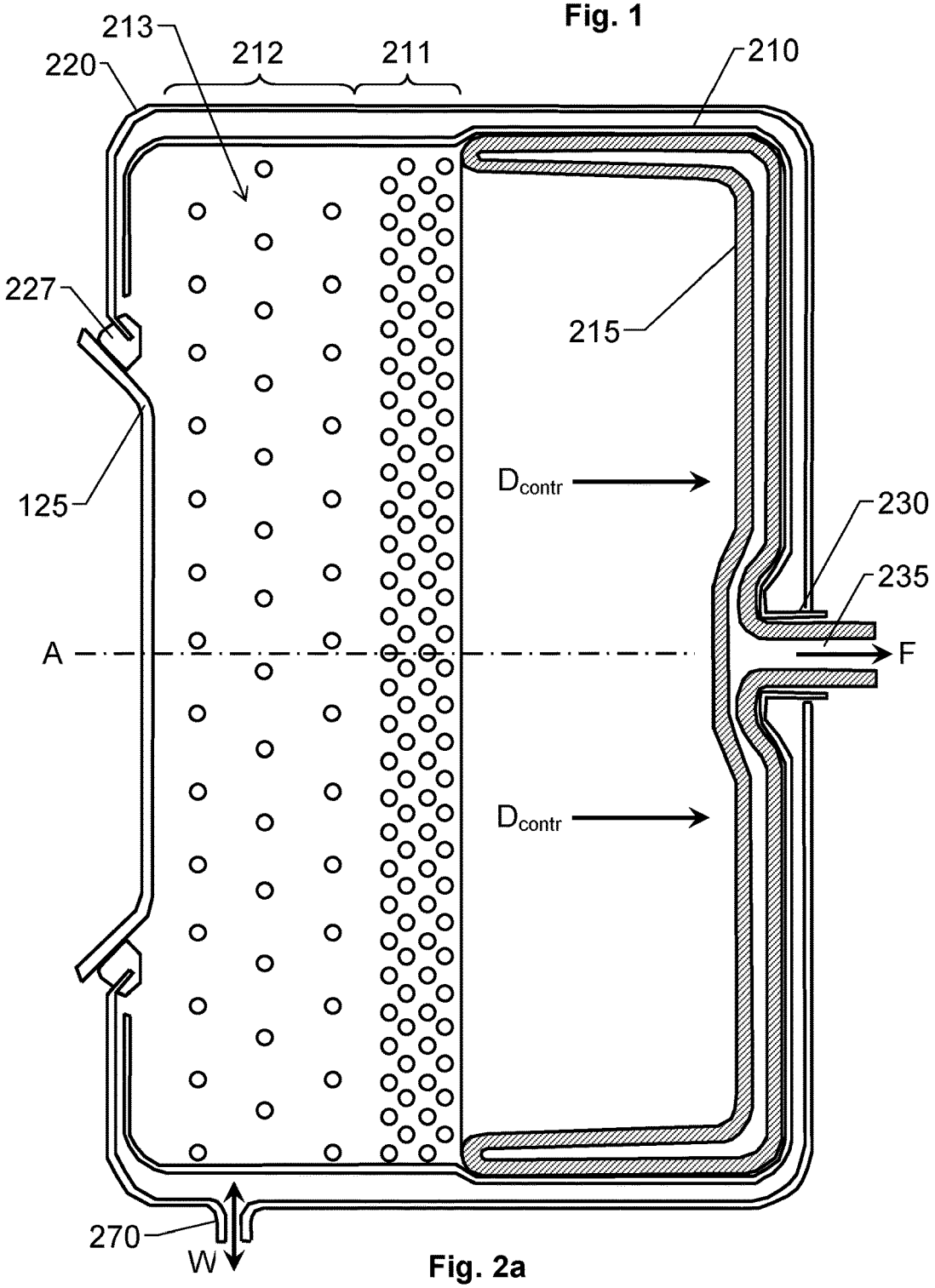
FIGS. 2*a-c* show cross-section views of a rotatable drum and a receiving chamber according to a first embodiment of the invention.

FIG. 2*a* shows cross-section view of the rotatable drum 210 and a surrounding receiving chamber 220 according to a first embodiment of the invention. The rotatable drum 210 contains at least one flexible body, which here is exemplified by a central flexible body 215 configured to alter its volume in response to a fluid medium F being fed into or extracted out from an interior of the central flexible body 215. As a result, a volume available for washing fluids W and the laundry 240 in the rotatable drum 210 varies. The fluid medium F may be represented by any type of gas, preferably air, and/or any type of liquid, preferably water. The washing fluids W typically contain water and various types of detergents, softeners and/or rinsing substances. The drum door 125 is surrounded by a watertight seal 227 to the receiving chamber 220 so that the washing fluids W remain inside the rotatable drum 210 and the surrounding receiving chamber 220 until being emptied via a pipe 270 controlled by an associated valve (not shown), and possibly a pump (not shown).

A rotating shaft 230 drives the rotatable drum 210 inside the receiving chamber 220. Preferably, the rotating shaft 230 includes a passage 235 that is configured to feed the fluid medium F into the central flexible body 215, and extract the fluid medium F out there from. This arrangement is beneficial because it allows the central flexible body 215 to be controlled to alter its shape and volume in an efficient and convenient manner via a pump mechanism (not shown) outside the rotatable drum 210 regardless of whether the drum 210 rotates or is stationary.

The main purpose of the rotatable drum 210 is to execute washing actions involving rotation of the rotatable drum 210 to cause the laundry 240 therein to tumble and be rearranged.

According to embodiments of the invention, the rotatable drum 210 may also execute washing actions involving rotation of the rotatable drum 210 while the at least one flexible body therein causes the laundry 240 to be kneaded against an inside surface of the rotatable drum 210.

Figure 2B:
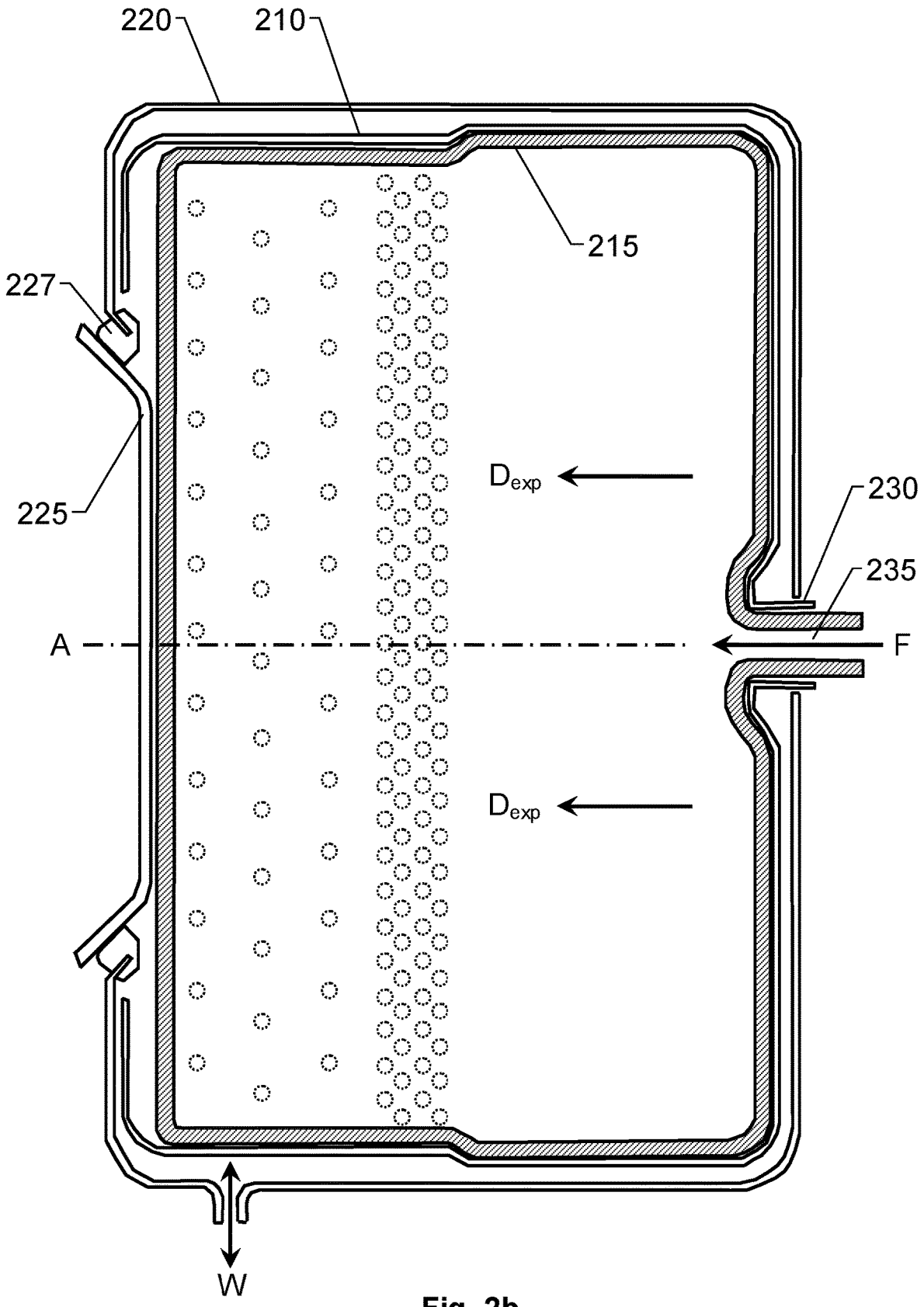
Figure 2C:
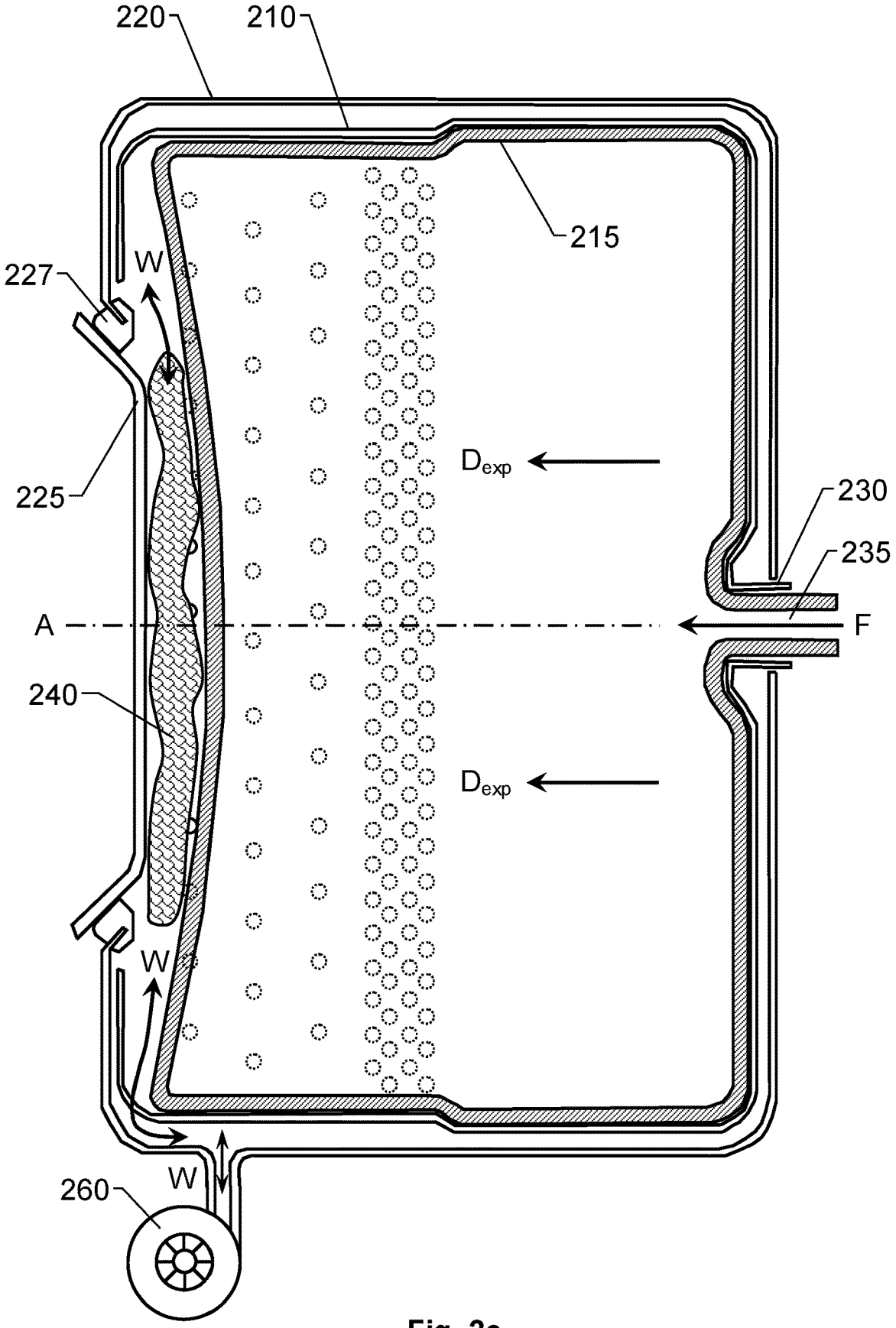

In FIG. 2*b*, we see a cross-section view of the rotatable drum 210 and the surrounding receiving chamber 220 according to the first embodiment of the invention when the central flexible body 215 has attained a maximal volume, i.e. has expanded all the way up against the drum door 225. Specifically, in this embodiment, the central flexible body 215 is configured to expand in an expansion direction $D_{exp}$ away from the passage 235. The expansion direction $D_{exp}$ is parallel to, or at least essentially parallel to, a symmetry axis A of the rotatable drum 210. Preferably, the central flexible body 215 covers the full diameter of the rotatable drum 210 so that it fills essentially the entire volume of the rotatable drum 210 when maximally expanded. Namely, this provides a highest degree of freedom as how to vary the volume available for the washing fluids W and the laundry 240 in the rotatable drum 210. Such a design of the central flexible body 215 also renders it possible to fixate pieces of laundry 240 against an inside surface of the rotatable drum 210 as illustrated in FIG. 2*c*. Consequently, the laundry 240 can be held stationary either during an entire washing program, or during one or more periods thereof. It is often beneficial if the laundry washing machine 100 operates in an alternating manner, wherein, in one phase, the rotatable drum 210 is controlled to rotate a few revolutions to turn around the pieces of laundry while the central flexible body 215 is contracted, and in another phase, the central flexible body 215 is expanded to knead the pieces of laundry while the rotatable drum 210 is stationary. Thereby, the washing liquids W can be systematically passed through different combinations of layers of fabric in the laundry 240. This, in turn, accomplishes a very efficient cleaning. Moreover, such a process means that the laundry 240 is pressed in a large number of angles, which leads to relatively few wrinkles and creases in the cleaned laundry 240.

According to one embodiment of the invention, the laundry washing machine 100 contains at least one pressure generator, schematically indicated by reference number 260 in FIG. 2*c*, which is configured to force the washing liquids W to pass through the laundry 240 while the at least one flexible body, exemplified by the central flexible body 215 in FIGS. 2*a* to 2*c*, causes the laundry 240 to be fixated against an inside surface of the rotatable drum 210, for instance the drum door 225, and the rotatable drum 210 is stationary.

In FIG. 2*c*, the at least one pressure generator is symbolized by reference number 260. In an actual implementation, the at least one pressure generator is typically represented by one or more pumps, for example a first pump configured to create a vacuum pressure for extracting the washing liquids W from the rotatable drum 210 by suction, and/or a second pump configured to create an overpressure for pushing the washing liquids W into the rotatable drum 210. Further, it is advantageous if these pumps operate in cooperation with a pump system for handling the fluid medium F. For example, the first pump may be assisted by one or more flexible bodies being expanded, and the second pump may be assisted by one or more flexible bodies being contracted.

Preferably, the laundry washing machine 100 contains a reservoir tank (not shown), which is configured to temporarily store washing liquids W that have been forced through the laundry 240 and been emptied from the rotatable drum 210. Thus, both water and detergents can be economized.

Moreover, alternatively, or additionally, the rotatable drum 210 may execute washing actions that involve rotating the rotatable drum 210 while the central flexible body 215 causes the laundry 240 to be kneaded against an inside surface of the rotatable drum, e.g. the drum door 225. This kneading is effected by pulsating the fluid medium F so that it is repeatedly fed into and out from the interior of the central flexible body 215. Thereby, the central flexible body 215 expands and contracts in a cyclic manner that causes the laundry 240 to be kneaded and rubbed while the washing liquids W are passed there though, thus providing efficient washing of delicate clothing being severely soiled. Analogous the expansion direction $D_{exp}$, the central flexible body 215 contracts towards the fluid-medium passage 235 in parallel with, or at least essentially in parallel with, the symmetry axis A of the rotatable drum 210.

Naturally, the pressure generator 260 may also be configured to force the washing liquids W to pass through the laundry 240 while the central flexible body 215 causes the laundry 240 to be kneaded against an inside surface of the rotatable drum 210, and while the rotatable drum 210 is either stationary or rotates. Generally, if the laundry 240 is severely soiled by dirt and/or particles, more rotation and kneading is necessary to attain a satisfying washing result; and if the laundry 240 contains delicate fabrics, it is advantageous to reduce such mechanical actions and instead force the washing liquids W through the laundry 240 in multiple passes.

For convenient discharge of the washing fluids W from the rotatable drum 210, it preferably contains a set of openings 213 configured to allow the washing fluids W to be discharged into the receiving chamber 220 that surrounds the rotatable drum 210.

Further preferably, the set of openings 213 contains first and second zones 211 and 212 respectively. In the first zone 211 a ratio between a total opening area and a total non-opening area is higher than the ratio between the total opening area and the total non-opening area in the second zone 212. It is advantageous if all the openings have a relatively small diameter, for example of equal size as shown in FIG. 2*a*, and the density of openings is higher in the first zone 211 than in the second zone 212. However, alternatively, the openings may instead be larger in the in the first zone 211 than in the second zone 212, and/or the shape of the openings may vary. Moreover, the set of openings 213 in the rotatable drum 210 may contain one or more zones in addition to the first and second zones of openings 211 and 212. In any case, the first zone 211 is located closer to the fluid-medium passage 235 than the second zone 212. This means that also if the central flexible body 215 has been expanded so that the washing volume in the rotatable drum 210 is reduced, the washing liquids W can exit efficiently from the rotatable drum 210.

Figure 3:
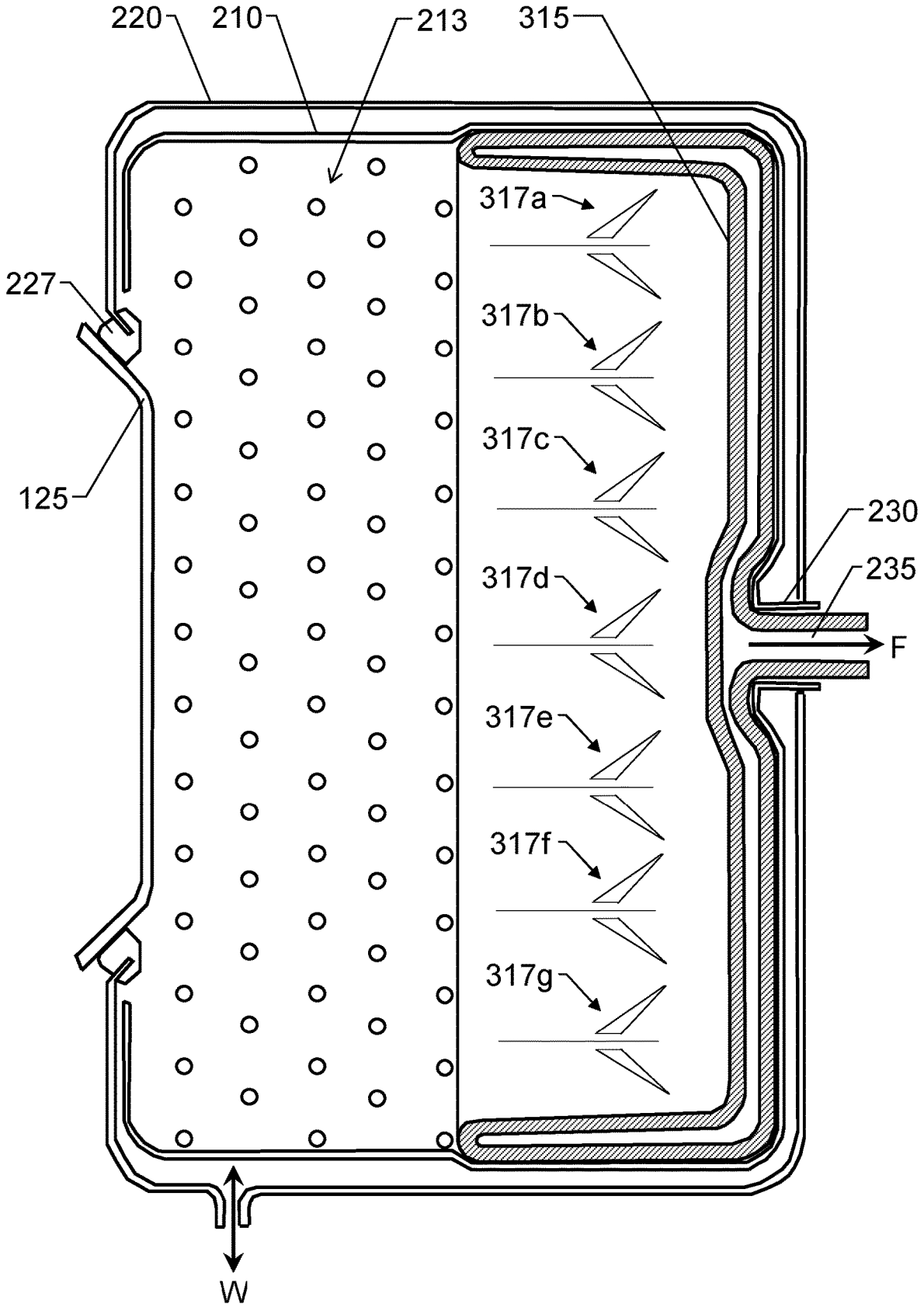
FIG. 3 shows a cross-section view of the rotatable drum and the receiving chamber according to a second embodiment of the invention.

FIG. 3 shows a cross-section view of the rotatable drum 210 and the receiving chamber 220 according to a second embodiment of the invention. Also here, the at least one flexible body is represented by a central flexible body 315 that is arranged symmetrically around the rotating shaft 230 in the rotatable drum 210, which central flexible body 315 is configured to expand and contract in expansion and contraction directions $D_{exp}$ and $D_{contr}$ respectively being parallel to the symmetry axis A of the rotatable drum 210, or at least essentially parallel to the symmetry axis A. An exterior side surface of the central flexible body 315 is exposed to the washing fluids W when the central flexible body 315 has been expanded to less than its maximal volume. The exterior side surface contains a number of fluid conveying patterns 317*a*, 317*b*, 317*c*, 317*d*, 317*e*, 317*f* and 317*g* configured to transport the washing fluids W from the exterior side surface towards the set of openings in the rotatable drum 210. This facilitates the emission of the washing liquids W from the rotatable drum 210 in phases of a washing program when the amount of washing liquids W is to be reduced. For further enhanced discharge efficiency, the central flexible body 315, or any multiple non-axial counterparts thereto, can be arranged with an angle to the rotatable drum 210 so that the exterior side surface leans towards the set of openings 213 in the contracted state.

Figure 4A:
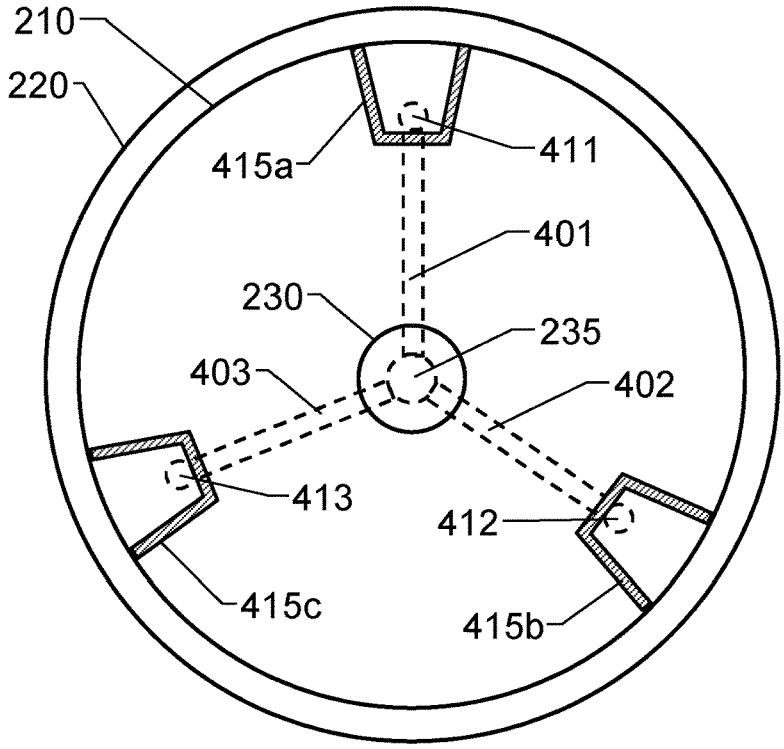
FIGS. 4*a-b* show front views of the rotatable drum and the receiving chamber according to a third embodiment of the invention.

FIG. 4*a* shows a front view of the rotatable drum 210 and the receiving chamber 220 as seen from the drum door 225 according to a third embodiment of the invention. Here, a number of flexible bodies 415*a*, 415*b* and 415*c* respectively are arranged non-axially relative to the rotating shaft 230 in the rotatable drum 210.

The fluid-medium passage 235 is comprised in the rotating shaft 230, so that the fluid medium F can be fed into and extracted out from flexible bodies 415*a*, 415*b* and 415*c* in an efficient manner regardless of whether the drum 210 rotates or is stationary. Specifically, a set of conduits 401, 402 and 403 interconnects the fluid-medium passage 235 and the flexible bodies 415*a*, 415*b* and 415*c* via openings 411, 412 and 413 respectively in a short side of the rotatable drum 210 located opposite to the drum door 225.

Analogous to what has been described above, the flexible bodies 415*a*, 415*b* and 415*c* are configured to receive the fluid medium F, so as to expand their volumes, and thus reduce the volume available for the washing fluids W and the laundry 240 in the rotatable drum 210. The flexible bodies 415*a*, 415*b* and 415*c* may also create delimited spaces for the washing fluids W and the laundry 240 inside the rotatable drum 210 as illustrated in FIG. 4*b*.

Figure 4B:
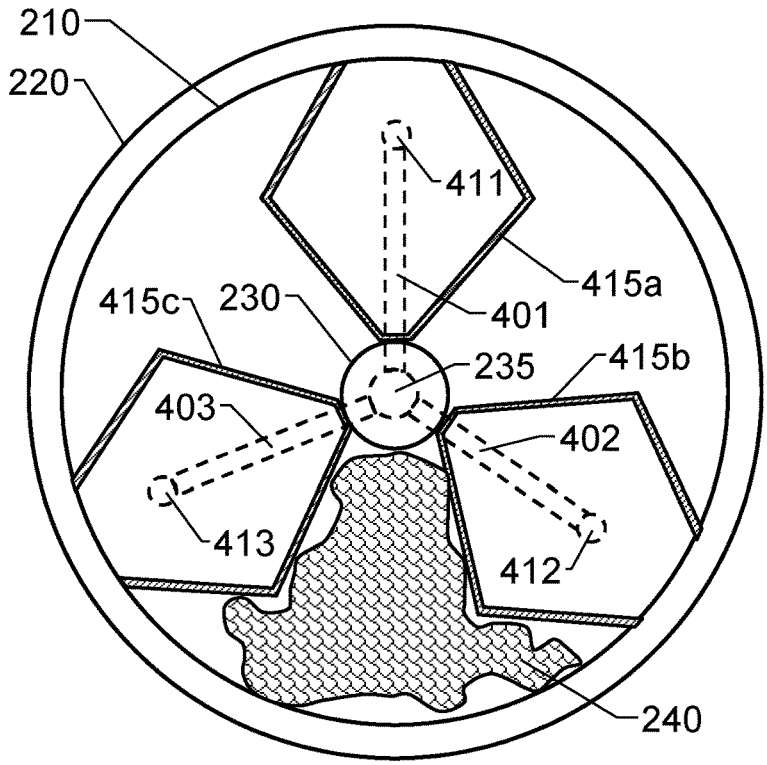

In FIG. 4*b*, we see the flexible bodies 415*a*, 415*b* and 415*c* in a respective maximally expanded states, where they connect with the rotating shaft 230 in the center of the rotatable drum 210. Consequently, the flexible bodies 415*a*, 415*b* and 415*c* create delimited spaces for the washing fluids W and the laundry 240 inside the rotatable drum 210. For example, here, a piece of laundry 240 is held in a such a delimited space between the flexible bodies 415*b* and 415*c*.

Figure 5A:
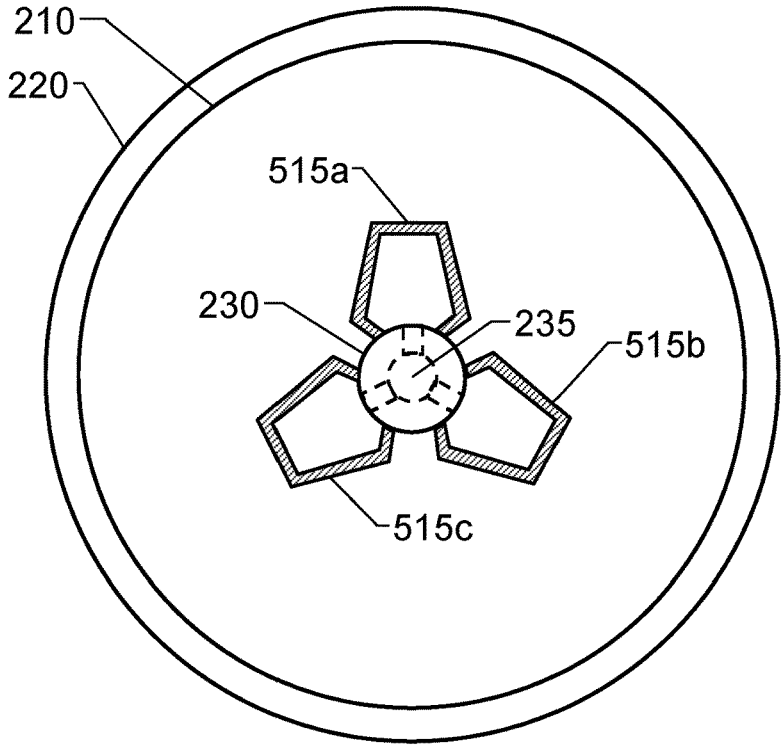
FIGS. 5*a-b* show front views of the rotatable drum and the receiving chamber according to a fourth embodiment of the invention.
Figure 5B:
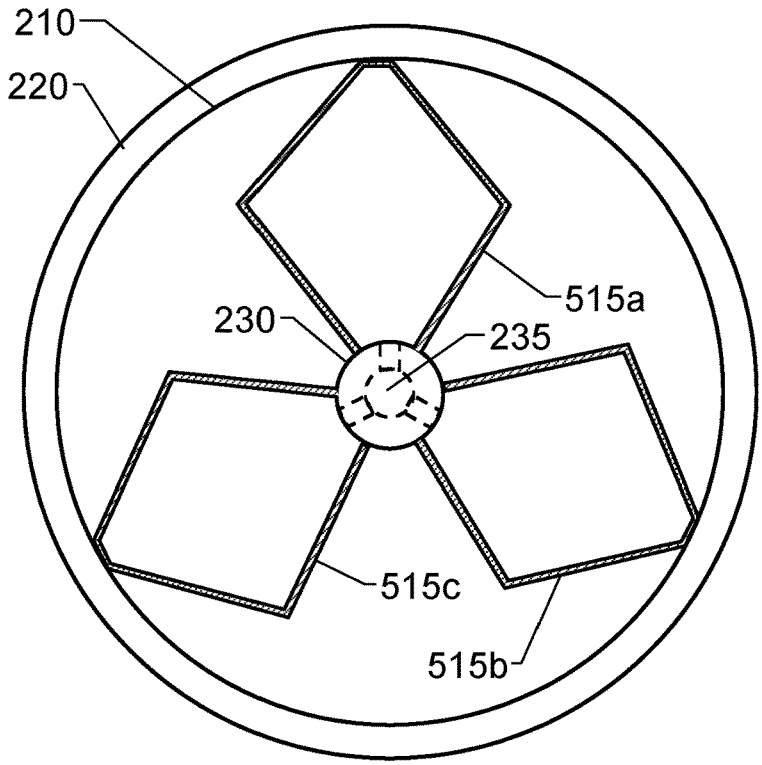

FIGS. 5*a* and 5*b* show front views of the rotatable drum 210 and the receiving chamber 220 as seen from the drum door 225 according to a fourth embodiment of the invention, which essentially constitutes a design being structurally opposite to the design shown in FIGS. 4*a* and 4*b*. In FIGS. 5*a* and 5*b* a number of flexible bodies 515*a*, 515*b* and 515*c* respectively are likewise arranged non-axially relative to the rotating shaft 230 in the rotatable drum 210. Here, however, the flexible bodies 515*a*, 515*b* and 515*c* are directly connected to the rotating shaft 230 and the fluid-medium passage 235 comprised therein. Hence, in this embodiment, the flexible bodies 515*a*, 515*b* and 515*c* are configured to receive the fluid medium F, so as to expand their volumes towards the side wall of the rotatable drum 210, and thus reduce the volume available for the washing fluids W and the laundry 240 in the rotatable drum 210.

Figure 6A:
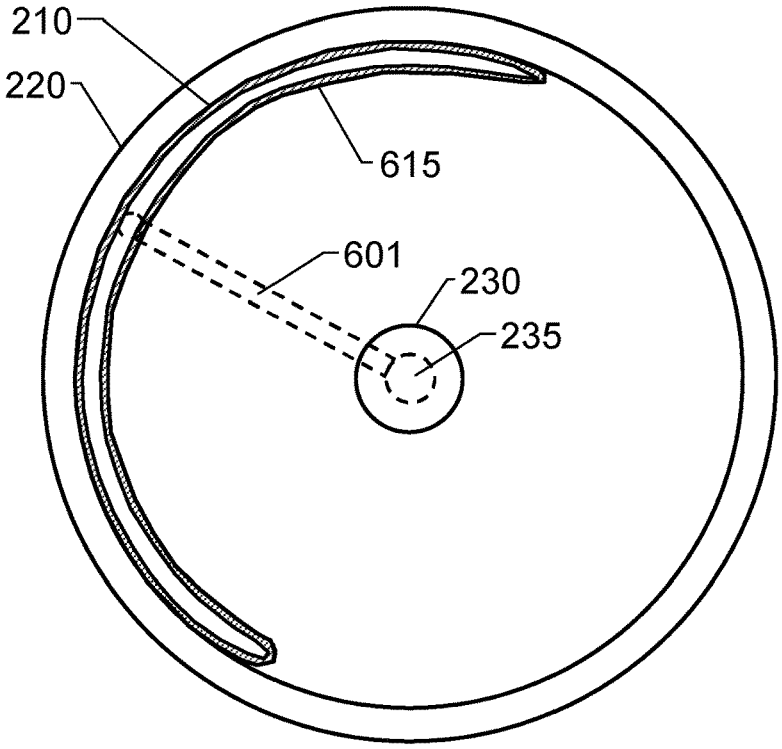
FIGS. 6*a-b* show front views of the rotatable drum and the receiving chamber according to a fifth embodiment of the invention.
Figure 6B:
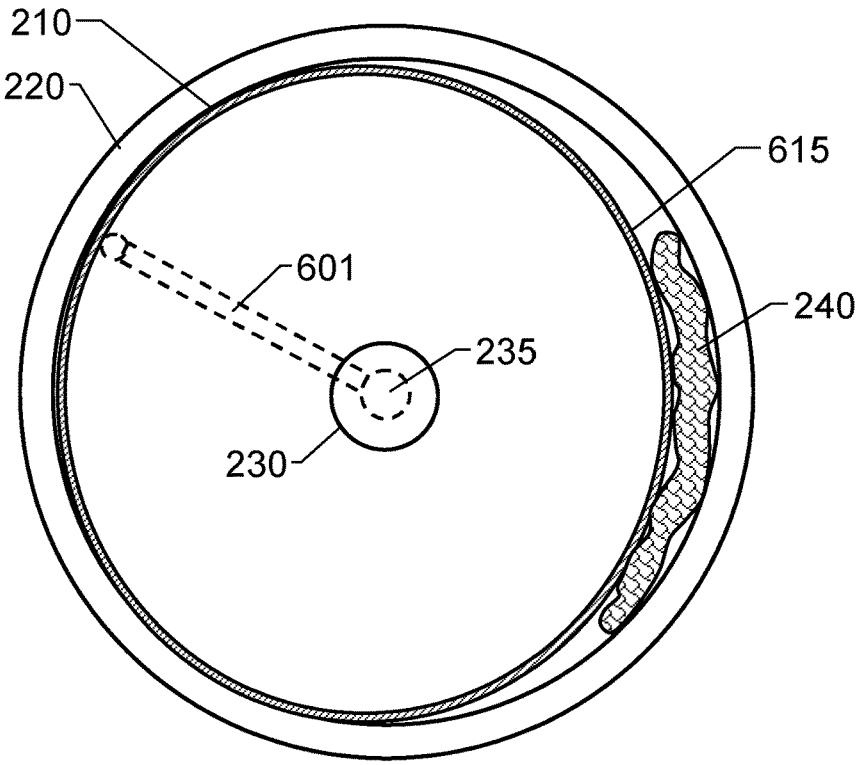

FIGS. 6*a* and 6*b* show front views of the rotatable drum 210 and receiving chamber 220 as seen from the drum door 225 according to a fifth embodiment of the invention. Here, one flexible body 615 is arranged non-axially relative to the rotating shaft 230 in the rotatable drum 210. Analogous to the third embodiment described above, the one flexible body 615 is connected to the fluid-medium passage 235 comprised in the rotating shaft 230 via a conduit 601. In a deflated state, as illustrated in FIG. 6*a*, the flexible body 615 is smoothed out along essentially half the interior side wall of the rotatable drum 210. In an maximally expanded state, as illustrated in FIG. 6*b*, the flexible body 615 occupies almost the entire volume inside the rotatable drum 210. As a result, depending on how much the flexible body 615 is expanded various amounts of laundry 240 can be kneaded and/or fixated against the side wall of the rotatable drum 210 when rotating or being stationary.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures; however it may be varied freely within the scope of the claims.

The invention claimed is:

1. A laundry washing machine, comprising:

a rotatable drum configured to hold laundry during washing thereof, at least one flexible body disposed within the rotatable drum and configured to alter the volume of the flexible body in response to a fluid medium being fed into or extracted out from an interior of the at least one flexible body, and as a result, varying a volume available for washing fluids and the laundry in the rotatable drum, and a rotating shaft driving the rotatable drum, which rotating shaft comprises a passage configured to feed the fluid medium into and extract the fluid medium out from the at least one flexible body, wherein at least one of the at least one flexible body is non-axially arranged relative to the rotating shaft in the rotatable drum.

2. The laundry washing machine according to claim 1, wherein the at least one flexible body is configured to receive the fluid medium so as to expand its/their volume until the laundry is fixated against an inside surface of the rotatable drum.

3. The laundry washing machine according to claim 1, wherein the at least one flexible body comprises one central flexible body arranged symmetrically around the rotating shaft in the rotatable drum, the central flexible body being configured to expand in an expansion direction away from the passage, which expansion direction is parallel to a symmetry axis of the rotatable drum.

4. The laundry washing machine according to claim 3, wherein the rotatable drum comprises a set of openings configured to allow the washing fluids to be discharged into a receiving chamber surrounding the rotatable drum.

5. The laundry washing machine according to claim 4, wherein: the set of openings comprises first and second zones; in the first zone a ratio between a total opening area and a total non-opening area is higher than the ratio between the total opening area and the total non-opening area in the second zone; and the first zone is located closer to the passage than the second zone.

6. The laundry washing machine according to claim 4, wherein an exterior side surface of the central flexible body is exposed to the washing fluids when the central flexible body has been expanded to less than a maximal volume, the exterior side surface comprising at least one fluid conveying pattern configured to transport the washing fluids from the exterior side surface towards the set of openings the rotatable drum.

7. The laundry washing machine according to claim 1 wherein the at least one flexible body is configured to receive the fluid medium so as to expand its/their volume to create at least one delimited space for washing fluids and the laundry inside the rotatable drum.

8. The laundry washing machine according to claim 1, wherein the rotatable drum is configured to execute washing actions comprising rotation of the rotatable drum to cause the laundry therein to tumble.

9. The laundry washing machine according to claim 1, wherein the rotatable drum is configured to execute washing actions comprising rotation of the rotatable drum while the at least one flexible body causes the laundry to be kneaded against an inside surface of the rotatable drum.

10. The laundry washing machine according to claim 1, comprising at least one pressure generator configured to force the washing liquids to pass through the laundry while the at least one flexible body causes the laundry to be fixated against an inside surface of the rotatable drum, and the rotatable drum is stationary.

11. The laundry washing machine according to claim 1, comprising at least one pressure generator configured to force the washing liquids to pass through the laundry while the at least one flexible body causes the laundry to be kneaded against an inside surface of the rotatable drum, and the rotatable drum is stationary.

12. The laundry washing machine according to claim 1, wherein the rotating shaft comprises a passage affixed to the at least one flexible body.

* * * * *